United States Patent [19]

Haldric et al.

[11] Patent Number: 4,852,380

[45] Date of Patent: Aug. 1, 1989

[54] METHOD AND DEVICE FOR SHAPING BY HAMMERING A CORRUGATED TUBE AND THE APPLICATION THEREOF TO TUBES FOR THE AUTOMOBILE INDUSTRY

[75] Inventors: Bernard Haldric, Vendome; Pascal Feucht, Amboise, both of France

[73] Assignee: NACAM, Vendome, France

[21] Appl. No.: 213,228

[22] Filed: Jun. 29, 1988

[30] Foreign Application Priority Data

Jul. 2, 1987 [FR] France ..... 87 09408

[51] Int. Cl.[4] ..... B21D 41/02; B21D 15/04; B21D 15/06

[52] U.S. Cl. ..... 72/402; 72/398; 72/393; 72/370

[58] Field of Search ..... 72/76, 466, 408, 402, 72/370, 398, 393

[56] References Cited

U.S. PATENT DOCUMENTS

| | | | |
|---|---|---|---|
| 743,192 | 11/1903 | Rainforth | 72/398 |
| 743,193 | 11/1903 | Rainforth | 72/398 |
| 1,890,039 | 12/1932 | Lange . | |
| 2,542,305 | 2/1951 | Brinen et al. | 72/393 |
| 3,345,730 | 10/1967 | Laverty | 72/393 |
| 3,494,170 | 2/1970 | Valleins | 72/398 |
| 4,182,152 | 1/1980 | Vaill et al. | 72/393 |

FOREIGN PATENT DOCUMENTS

| | | | |
|---|---|---|---|
| 96609 | 4/1924 | Fed. Rep. of Germany | 72/393 |
| 894860 | 11/1953 | Fed. Rep. of Germany . | |
| 2027638 | 12/1971 | Fed. Rep. of Germany . | |
| 3514485A1 | 1/1985 | Fed. Rep. of Germany . | |
| 696064 | 12/1930 | France | 72/398 |
| 2176707 | 11/1973 | France . | |
| 70431 | 5/1980 | Japan | 72/370 |

*Primary Examiner*—Daniel C. Crane

*Attorney, Agent, or Firm*—Wenderoth, Lind & Ponack

[57] ABSTRACT

A shaping device for corrugating a tube includes at least one mandrel which is radially expansible and has a body associated with at least one relatively resilient arm which carries on its surface an impression whose profile corresponds to the profile of the corrugation to be obtained, and an axially movable locking member for causing the mandrel to move from a retracted position to an outer position in which the locking member immobilizes the mandrel, and hammers. The hammers, the tube and the mandrel-locking member are adapted to be subjected to relative rotations about their common longitudinal axis.

11 Claims, 3 Drawing Sheets

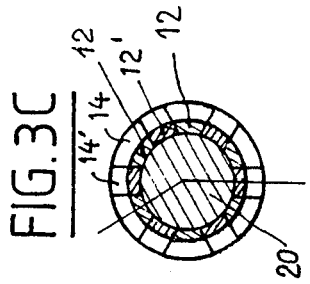
FIG. 3C
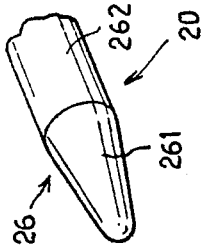
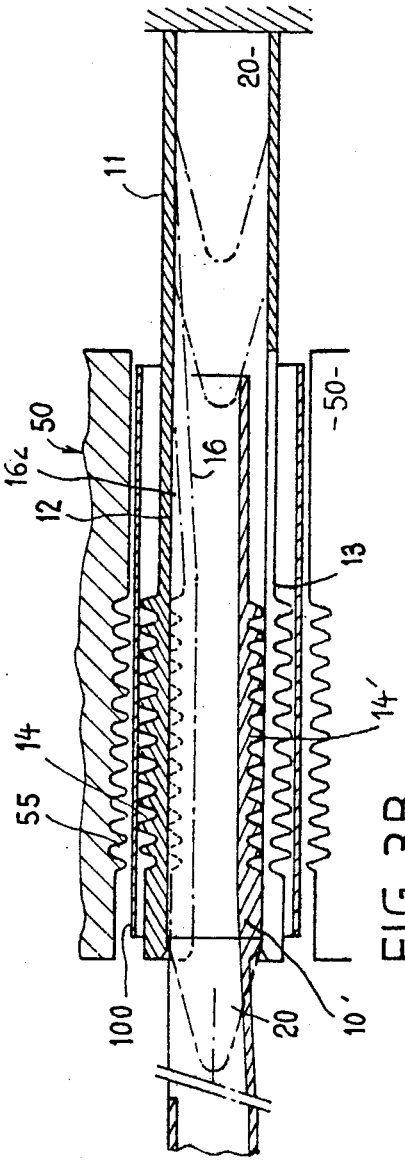
FIG. 3B
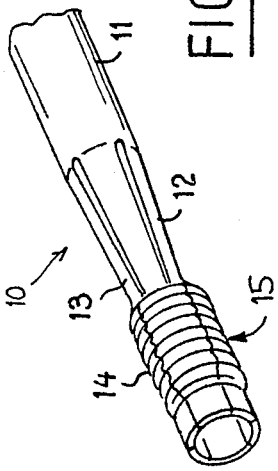
FIG. 3A
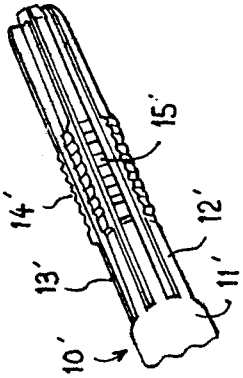

METHOD AND DEVICE FOR SHAPING BY HAMMERING A CORRUGATED TUBE AND THE APPLICATION THEREOF TO TUBES FOR THE AUTOMOBILE INDUSTRY

BACKGROUND OF THE INVENTION

The invention relates to the manufacture of corrugated tubes and more particularly to the shaping of such tubes by hammering. The invention more particularly is directed to providing a method and a device for shaping by hammering a tube so as to impart thereto in particular a corrugated configuration, and to the application of such a tube in for example, the automobile industry.

As is known, corrugated tubes, whether their cross-section be circular or otherwise and the corrugations be helical or otherwise, are used in different fields in industry.

For example, there are employed such tubes which have a certain flexibility in both the axial and transverse directions for absorbing differences in alignment or expansions of tubular pipes subjected to thermal stresses or mechanical stresses such as vibrations. Such tubes compensate for the longitudinal expansions and/or take into account defects in the axial alignment between different pipes located on each side of the corrugated tube section.

Another application in the automotive field consists in using the tube for absorbing energy developed by the driver who is thrown forward as a result of a relatively violent front collision; the driver, by a return shock, strikes the driving wheel and there is a risk of the latter producing serious thoracic lesions if it is incapable of at least partly withdrawing under the impact of the driver. This is for example the reason why such corrugated tubes are located immediately behind the steering wheel between the latter and the dashboard, or behind the dashboard between two rigid sections of the upper part of the steering column placed between the mounting of the column on the dashboard and the steering box.

Such applications of corrugated tubes are common. It will therefore be understood that the manufacture of such tubes is of considerable practical interest. At the present time, a currently-employed solution for manufacturing a corrugated tube consists in deforming the tube under the action of a high hydraulic pressure; there is carried out an operation which is usually termed "a hydraulic forming" in the art. An oil pressure is developed within the tube and optionally combined with an axial thrust so as to deform the tube against a female member which has impressions of the corrugations to be obtained. Simultaneously with the inflation of the tube which expands, all the corrugations thus obtained move closer together and thus permit conserving a substantially constant thickness of the metal of the walls of the corrugations. Each outer female part which carries the impression of a corrugation is controlled mechanically or hydraulically.

Such a manufacturing technique, however, presents drawbacks. Indeed, it requires a very complex specific machine which can only form a small number of corrugations in each operational cycle of the machine. Use is made of a pressure developed by the oil and it is difficult to eliminate the residual oil which remains inside the shaped corrugated tube. Furthermore, the profile of the corrugations must be very progressive if good results are to be obtained.

Another solution is that disclosed in the French Pat. Application No. 2 176 707. This document proposes manufacturing corrugated tubes by means of an apparatus which comprises a mandrel carrying on its periphery impressions of the corrugations to be obtained, and a ring arrangement of toothed wheels placed radially therearound with their axes orthogonal to the mandrel axis. These wheels carry on their periphery impressions of the corrugations to be obtained which are complementary to those of the mandrel. The tube to be shaped is placed between the wheels and the mandrel whose impressions interengage in the manner of teeth of gear wheels and thus deform the tube which is advanced in a single axial translation with the mandrel through the ring arrangement of toothed wheels to the exclusion of any rotation which would be disadvantageous.

Another technique resides in the deformation of the tube by hammering. This is achieved by means of hammers which are subjected to reciprocating radial movements relative to the axis of the tube and which come to bear periodically with more or less brutality against the outer periphery of the tube to effect a deformation by hammering. This technique permits obtaining local reductions in the diameter, flat portions and successive narrowings. Sometimes, in some cases, in order to avoid a crushing of the tube under the forces developed by the various hammers, it may be desirable to dispose in the tube a core whose profile corresponds to the profile of the configuration to be given to the tube; this is, for example, employed when manufacturing splined tubes by means of a complementary splined core. For carrying out this technique, there are employed hammers which are disposed equally spaced apart on the periphery of the tube to be shaped and are periodically shifted in a reciprocating manner and in succession for example by means of rollers which circulate in a cage roughly in the manner of a roller bearing.

Depending on the results to be obtained, the dimensions and the type of the tube to be shaped, the number of hammers used rarely exceeds twelve.

As this complex hammering technique is well known, it need not be referred to in more detail. The numerous drawbacks of this technique are also known and are similar to those previously discussed with respect to the hydraulic forming operation.

SUMMARY OF THE INVENTION

An object of the invention is to overcome most of the drawbacks of the hydraulic forming operation by employing a technique which makes use of conventional non-specialized machines by using a particular tooling employed in a special way.

The invention provides a device for shaping by hammering a tube so as to impart thereto a corrugated conformation by means of at least one hammer which is radially movable relative to the axis of the tube to be shaped. This device comprises a mandrel which has at least one hollow body with which there is associated at least one arm which carries on the surface thereof a partial impression whose profile corresponds to the profile of the corrugation to be obtained and which is adapted to cooperate with the tube and is radially movable between a retracted position to permit the tube to be placed in position and extracted and an outer position to permit the hammering of the tube, and a preferably solid locking member which cooperates with the mandrel and is axially movable between a first position to permit the mandrel to occupy the retracted position thereof and a second position to permit the mandrel to occupy the outer position thereof. The hammer, the tube, and the mandrel-locking member are adapted to be subjected to relative rotations about their common axis.

The invention also provides a method for shaping by hammering a tube so as to impart thereto in particular a corrugated conformation by means of at least one hammer which is radially movable relative to the axis of the tube to be shaped, said method comprising subjecting the tube preferably internally to a device which comprises a mandrel having at least one hollow body with which there is associated at least one arm which carries on the surface thereof a partial impression whose profile corresponds to the profile of the corrugation to be obtained and which is adapted to cooperate with the tube and which is radially movable between a retracted position for placing the arm in position and extracting the arm relative to the tube and an outer position to permit the hammering of the tube, axially shifting a preferably solid locking member which is cooperative with the mandrel between a first position in which the mandrel is in the retracted position thereof and a second position to enable the mandrel to assume the outer position thereof, actuating the hammer for applying the tube against the impression and impart thereto the corrugated conformation thereof, imparting to the hammer, the tube, and the mandrel-locking member relative rotations about their common axis, axially shifting the locking member from the second position to the first position thereof, and disengaging the shaped tube.

The invention also provides the application of such a method and such a device in the shaping of corrugated tubes composed of in particular steel for automobiles.

BRIEF DESCRIPTION OF THE DRAWINGS

Further features of the invention will be apparent from the following description and claims with reference to the accompanying drawings which are given solely by way of example, and in which:

FIGS. 3A, 3B and 3C are views similar to FIGS. 2A, 2B and 2C of another embodiment of the invention.

DETAILED DESCRIPTION OF THE INVENTION

As the techniques of hammering are familiar to those skilled in the art of tube-shaping, the following description will be limited to that which directly or indirectly concerns the invention. One skilled in the considered art would be able to deduce further details from available conventional solutions adapted to the special cases which must be solved in accordance with the objectives to be attained and the requirements to be satisfied.

Figure 1A:
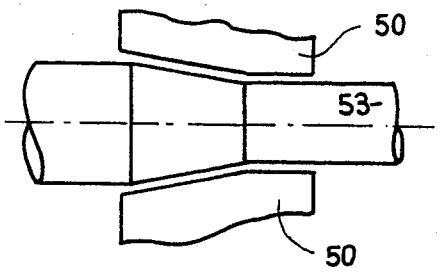
FIGS. 1A, 1B and 1C illustrate the conventional technique for shaping a tube by hammering.
Figure 1B:
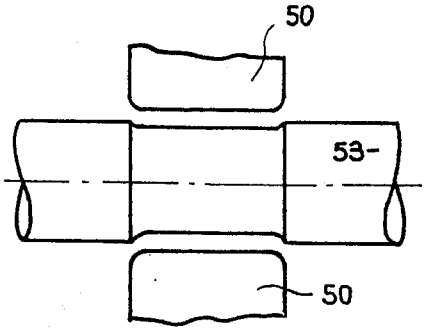
Figure 1C:
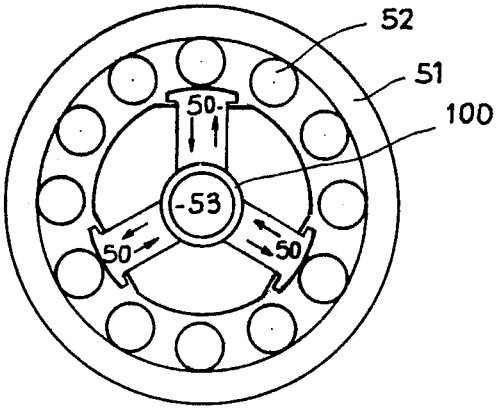

FIGS. 1A and 1B illustrate diagrammatically the conventional technique of shaping by hammering a tube, FIG. 1A representing the obtaining of a narrowing and FIG. 1B the obtaining of a local reduction in diameter. FIG. 1C is a diagrammatic cross-sectional view of the manner in which the hammers are actuated for shaping a tube by hammering. As seen in these Figures, hammers 50 act on a tube 100 in which may be engaged, if need be, a core 53 of suitable shape including impressions the profile of which corresponds to the configuration to be obtained on the tube. The hammers periodically move toward or away from the tube simultaneously or in turn, under the action of rollers 52 which travel in a cage 51. Thus it can be seen that each time a roller passes through the longitudinal axis of a radially reciprocating hammer, this roller exerts a thrust on the hammer and applies it against the tube which may be supported by the inner core. The number of hammers and rollers and the relative movements of the cage, the hammers and the tube depend on the profile to be shaped on the tube, on the type of material of the latter and on its dimensions and on the characteristics of the machine. No further description of this technique will therefore be given.

As mentioned, the invention employs a machine of this type by equipping it with a device to render it suitable for manufacturing by hammering corrugated tubes. As recalled, when a hammering technique is desired to be employed, it is sometimes necessary to use a support for the tube which is preferably placed inside the latter.

Figure 2C:
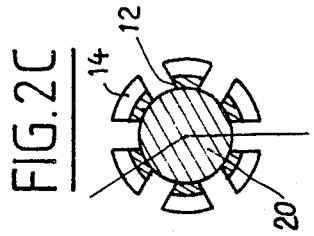
FIGS. 2A, 2B and 2C represent a first embodiment of a device according to the invention, in disassembled perspective, in a meridian section and a cross-section, respectively.
Figure 2B:
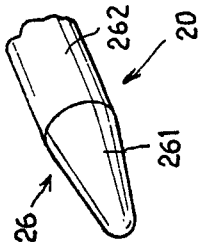
Figure 2B:
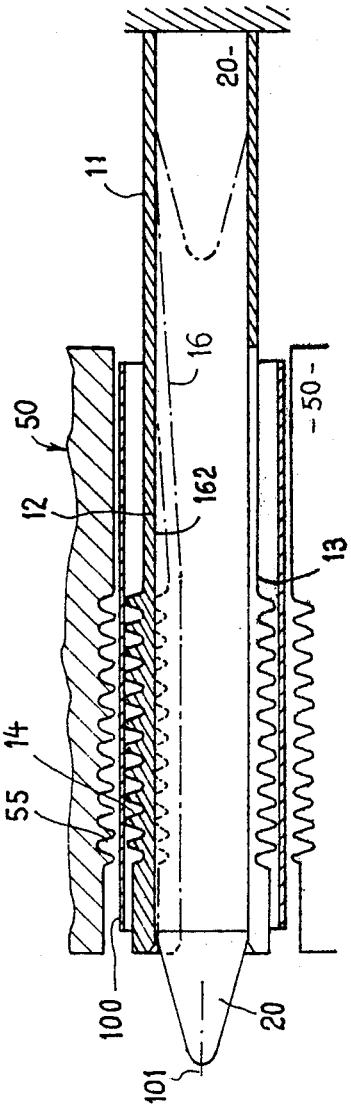
Figure 2A:
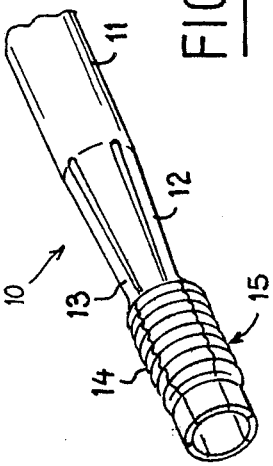

The invention uses a conventional machine by adding thereto a retractable device which enables the device to be placed in the workpiece to be shaped and to be extracted when the shaping has been effected. Reference will be made to FIGS. 2A, 2B and 2C where a first embodiment of the device according to the invention is illustrated.

The device for shaping by hammering a tube 100, so as to impart thereto a corrugated conformation 110 (FIG. 4) by means of at least one hammer 50 which is radially movable relative to the axis 101 of the tube to be shaped, comprises a mandrel 10 which has a hollow body 11 with which there is associated at least one arm 12 carrying on the surface 13 thereof a partial impression 14 whose profile 15 corresponds to the profile of the corrugation to be obtained. This mandrel is adapted to cooperate with the tube and is radially movable between a retracted position to permit the tube to be placed in position and extracted and an outer position for hammering the tube. The retracted position is shown in FIG. 2A and in dot-dash lines in FIG. 2B. The outer position is shown in full lines in FIGS. 2B and 2C. This device further comprises a preferably solid locking member 20 which cooperates with the mandrel 10. This locking member is axially movable between a first position to permit the mandrel to occupy the retracted position thereof and a second position to permit the mandrel to occupy the outer position, as will be understood hereinafter.

Preferably, the arm 12 is integral with the body and has an inherent resilience which naturally tends to urge the mandrel to one of its two positions and preferably toward its retracted position illustrated in FIG. 2A. As can be seen, the locking member 20 carries a cam 26 and the mandrel a counter-cam 16 which is cooperative with the cam of the locking member. Preferably, the cam 26 is a cone 261 followed by a cylinder of revolution 262. The counter-cam 16 preferably has a circular cross-sectional shape and is conical in the retracted position and cylindrical 162 in the outer position of the mandrel 10.

As can be seen in the drawings, the arm carries on the surface 13 partial impression 14 whose profile corresponds to the profile of the corrugation to be obtained on the tube.

FIG. 2A illustrates this first embodiment in the disassembled position out of the tube. FIG. 2B shows in full lines the device according to the invention in the outer position thereof ready to support the tube 100 to be hammered and in dot-dash lines in the retracted position of the device, enabling the device to be placed in the machine. This view is a section taken in the offset plane shown in FIG. 2C.

FIG. 2C is a cross-sectional view of the locking member in the second position thereof and the mandrel in the outer position thereof.

It will therefore be understood that with the mandrel in the retracted position, the impressions tend to be in adjoining relation to each other, owing to the inherent resilience of the arms carrying these impressions. If the locking member is axially forced into the body of the mandrel 10, the cone 261 of the cam 26 exerts a thrust on the counter-cam 16 of the arms and first of all causes them to project outwardly; then, in continuing the insertion of the locking member 20, the cone 261 places the mandrel in the outer position thereof and finally locks it in this position.

The tube to be shaped is therefore supported internally and it may be hammered in the usual manner by means of hammers which have been provided with impressions 55 of complementary profile as illustrated.

The number of arms is not critical. In the illustrated embodiment six arms are shown.

Thus it can be seen that, when the locking member is axially shifted from the first position thereof relative to the mandrel to the second position, it expands the arms of the mandrel. These arms open to substantially the dimension of the corrugated tube to be obtained. The tube to be shaped, which is initially cylindrical and has a diameter equal to or greater than the outside peripheral diameter of the corrugation parts of the impressions of the arms in the outer position thereof, may be mounted on the mandrel when the locking member is in either of the first or second positions thereof or inversely.

When the tube is in position and the locking member occupies the second position thereof, the hammer or hammers strike the tube and radially deform it in accordance with the profile of the impressions.

According to the invention, in order to obtain the shaping of corrugations throughout the circumference of the tube by means of this embodiment of the device, the tube, the hammer and the mandrel-locking member assembly must be relatively rotated about their common longitudinal axis. This mandrel-locking member assembly rotates at a speed which is synchronous with that of the hammers as a function of the number of supporting impressions carried by the mandrel relative to the number of active hammers. The manner in which these hammers, the tube, the mandrel-locking member are assembled and supported to be capable of rotating about their common longitudinal axis, and the manner in which they are rotated about this axis at distinct specific speeds so that they effect relative displacements, employ conventional solutions which are chosen in accordance with each specific case by, if need be, adapting them.

After shaping and the return of the hammers to the position radially spaced from the axis of the tube, the locking member is returned from the second position to the first position thereof. This enables the impressions to retract in the centripetal or inward direction owing to the inherent resilience of the arms of the mandrel carrying the impressions. Thus, it can be seen that the mandrel then spontaneously resumes the retracted position thereof; when the mandrel occupies this position, it is possible to remove the tube since the impressions are disengaged from the corrugations shaped on the tube.

Reference will now be made to FIGS. 3A, 3B and 3C which show an improvement in the embodiment shown in FIGS. 2A, 2B and 2C.

As can be seen, in particular in FIG. 2C, when the mandrel is in the outer position thereof, a gap exists between each arm and upon each strike of the hammers only an arc of a corrugation is obtained. In order to eliminate this drawback, another mandrel is employed whose arms, when they are in the outer position, fill the vacant gaps existing between the arms of a first mandrel. When these two mandrels are then in the outer positions thereof, the arms of one occupy the gaps between the arms of the other mandrel. Thus it can be seen that, in this embodiment, the two mandrels are assembled in head-to-toe relation and their respective arms are imbricated one between the other.

In order to shorten the description, similar elements carry the same reference numerals to which a "prime" sign is added.

The operation of this second improved embodiment is as follows:

The tube 100 to be shaped is slipped over the first mandrel 10 whose arms 12 are in the opened out or outer position owing to the action of the locking member 20 which occupies the second position thereof. The second mandrel 10' is placed in position by translation in the first mandrel 10, or inversely, and the locking member continues its translation in such manner as to cause the expansion of the arms 12' of the second mandrel which then come to fill the gaps left vacant by the arms of the first mandrel, as previously indicated and illustrated in FIGS. 3B and 3C.

After the locking of the two mandrels in the outer position thereof, the hammers come to strike the tube and deform it on the corrugated impressions, as previously mentioned.

The assembly comprising the hammers, the tube and the device effect a relative rotation.

In order to unlock the device, the locking member 20 is moved axially during which it passes from the second position thereof to the first position which enables each of the mandrels 10', 10 to be disengaged in succession, these mandrels having, as mentioned, arms 12', 12 which have an inherent resilience which tends to urge them to their retracted position. As can be seen, the corrugated tube shaped in this way is released from the device by operating in the opposite way to that described at the beginning of the procedure.

When this has been done, the tube may be manually withdrawn or ejected by the rearward movement of the mandrel. It is also possible to take hold of the tube obtained by means of a robot or an automaton.

The interest of the invention and its features will be clear from the foregoing description.

As is clear, owing to the invention, it is possible to obtain, by giving an adapted suitable shape to the impression, simultaneously by hammering corrugations, a conical or cylindrical reduction in size.

Figure 4:
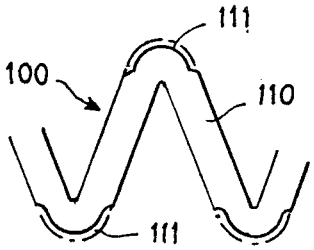
FIG. 4 is a partial meridian sectional view of a section of a corrugated tube shaped in accordance with the invention.

Furthermore, as diagrammatically shown in FIG. 4, the thickness of the corrugation of the tube may be locally varied by giving the impressions appropriate profiles. This permits refining the configuration of the profile of the corrugations obtained, so as to impart to the tube shaped in this way required mechanical characteristics, for example to satisfy well-defined conditions of radial and/or axial performance as a function of the displacements thereof. In FIG. 4, the crests 111 of the corrugations are locally reduced in thickness.

It will also be observed that the invention permits obtaining a large number of profiles, and in particular producing corrugations which are non-circular or have any other profile which may be formed by hammering, for example hexagonal corrugations. Helical corrugations may also be obtained.

The impressions are in one piece with the arms and/or the hammers or are mounted the latter. The choice of the materials from which they are made is a function of the dimensions and the type of material, for example steel, of the tube to be shaped. Tubes may be shaped whose wall thickness is between about 0.1 and 10 mm, for example, by correspondingly adapting the equipment and the tooling. Owing to the invention it is easy to shape, for example steel tubes whose outside diameter is on the order of 60 mm and whose wall thickness is on the order of 2 mm, and form corrugations of a length which may, at least, be as much as twice the diameter, for example.

It will moreover be observed that, in addition to the technical advantages, the invention affords notable economical advantages, since the cost of producing a tube obtained in accordance with the invention is less than that resulting from a hydraulic forming operation. Indeed, the work is carried out more rapidly by hammering and the tooling cost is lower. Furthermore, it is no longer necessary to degrease the shaped tube so as to remove traces of hydraulic forming oil.

The invention permits obtaining corrugated tubes which are particularly suitable for applications in the technical field of the automobiles. These corrugated tubes are especially suitable for the upper part of the steering columns of automobiles which are deformable in the event of impact, whether this be directly at the moment of a collision, or immediately after at the moment of the return impact of the driver thrown against the steering wheel.

However, the applications of the invention are not limited to merely the automobile field, and are also suitable for example for pipes when it concerns taking into account defects of alignment or expansions.

We claim:

1. A device for shaping by hammering a tube having a longitudinal axis for imparting thereto a corrugated shape, said device comprising:

circumferentially spaced-apart hammers movable relative to the axis of the tube in radial planes away from and toward the tube for striking the tube and forming the corrugated shape therein, each said hammer defining a corrugated impression for contributing to the imparting of the corrugated shape to the tube;

a mandrel to be placed coaxially inside a tube to be shaped and having a hollow body and circumferentially spaced-apart arms connected to and longitudinally extending from said body;

each said arm carrying an end part remote from said body and defining a corrugated impression of a given axial extent and cooperative with said impressions of said hammers;

said arms being angularly movable in radial planes relative to the body between an outer position, whereat said end parts are adjacent to the tube for supporting the tube during the striking of the tube by said hammers, and an inner position, whereat said end parts are spaced radially away from the tube;

said end parts having rectilinear inner surfaces parallel to said axis in said outer position of said arms and inclined toward said axis in a direction away from said body in said inner position of said arms;

means for elastically biasing said arms to said inner position;

a locking member located coaxially within said mandrel and defining a generally cylindrical surface, said locking member being axially movable between a first position, whereat said cylindrical surface thereof is in engagement with said rectilinear surfaces of said end parts to an axial extent substantially equal to said given extent of said impressions on said end parts and substantially in radial alignment with said impressions of said end parts and locks and firmly supports said end parts in said outer position of said arms in opposition to the action of said biasing means, and a second position, whereat said locking member is withdrawn from said rectilinear inner surfaces to allow said arms to move to said inner position; and said hammers, the tube and said mandrel being relatively rotatable about said axis to allow said hammers to act on the entire periphery of the tube.

2. Device according to claim 1, wherein each said arm is in one piece with said body and has an inherent resilient which acts as said biasing means.

3. Device according to claim 1, wherein said locking member has a tapered end portion acting as a cam for facilitating the shifting of said arms to said outer position, said cylindrical surface of said locking member being adjacent to said tapered portion.

4. Device according to claim 1, wherein each said end part is in one piece with the respective said arm.

5. Device according to claim 1, wherein the profiles of the cooperative said impressions of said hammers and of said parts are so chosen as to produce a local modification of the thickness of the tube when the shaping thereof has terminated.

6. Device according to claim 5, wherein said modification of the thickness of the tube concerns at least crests of the corrugations produced in the tube.

7. Device according to claim 1, wherein the profile of the corrugations is in the shape of an accordian fold.

8. Device according to claim 1, wherein the profile of the corrugations is of helical shape.

9. A device for shaping by hammering a tube having a longitudinal axis for imparting thereto a corrugated shape, said device comprising:

circumferentially spaced-apart hammers movable relative to the axis of the tube in radial planes away from and toward the tube for striking the tube and forming the corrugated shape therein, each said hammer defining a corrugated impression for contributing to the imparting of the corrugated shape to the tube;

a first mandrel to be placed coaxially inside a tube to be shaped and having a hollow body and circumferentially spaced-apart arms connected to and longitudinally extending from said body;

each said arm carrying an end part remote from said body and defining a corrugated impression of a given axial extent and cooperative with said impressions of said hammers;

said arms being angularly movable in radial planes relative to said body between an outer position, whereat said end parts are adjacent to the tube for supporting the tube during the striking of the tube by said hammers, and an inner position, whereat said end parts are spaced radially away from the tube;

said end parts having rectilinear inner surfaces parallel to said axis in said outer position of said arms and inclined toward said axis in a direction away from said body in said inner position of said arms;

means for elastically biasing said arms to said inner position;

a locking member located coaxially within said mandrel and defining a generally cylindrical surface, said locking member being axially movable between a first position, whereat said cylindrical surface thereof is in engagement with said rectilinear surfaces of said end parts to an axial extent substantially equal to said given extent of said impressions on said end parts and substantially in radial alignment with said impressions of said end parts and locks and firmly supports said end parts in said outer position of said arms in opposition to the action of said biasing means, and a second position, whereat said locking member is withdrawn from said rectilinear inner surfaces to allow said arms to move to said inner position;

a second mandrel coaxial with said first mandrel and having a hollow second body and circumferentially spaced-apart second arms longitudinally extending from said second body and carrying second end parts remote from said second body defining second corrugated impressions for cooperation with said impressions of said hammers, said second mandrel being axially movable between an inoperative position, whereat said second end parts are disengaged from said end parts of said first mandrel, and an operative position, whereat said second end parts are in imbricated relation to said end parts of said first mandrel when said arms of said first mandrel are in said outer position thereof;

said second end parts having rectilinear surfaces which are engaged on said cylindrical surface of said locking member and supported and locked in position by said cylindrical surface of said locking member in said operative position and in said first position of the locking member, whereby said impressions on said imbricated end parts and second parts are substantially circumferentially continuous; and said hammers, the tube and said two mandrels being relatively rotatable about said axis to allow said hammers to act on the entire periphery of the tube.

10. Device according to claim 9, wherein said second mandrel is disposed in axially reversed relation to said first mandrel so that said second arms extend between said arms of said first mandrel toward said body of said first mandrel in said operative position of said second mandrel.

11. Method of shaping by hammering a tube having a longitudinal axis for imparting thereto a corrugated shape by means of a device comprising a mandrel to be placed coaxially inside said tube and having a hollow body and circumferentially spaced-apart arms connected to and longitudinally extending from said body, circumferentially spaced-apart hammers movable relative to said axis in radial planes away from and toward said tube for striking said tube and forming said corrugated shape, each hammer defining a corrugated impression for contributing to the imparting of said corrugated shape to said tube, each said arm carrying an end part remote from said body and defining a corrugated impression of a given axial extent and cooperative with said impressions of said hammers, said arms being angularly movable in radial planes relative to said body between an outer position, whereat said end parts are adjacent to said tube for supporting said tube during the striking of said tube by said hammers, and an inner position, whereat said end parts are spaced radially away from said tube, said end parts having rectilinear inner surfaces parallel to said axis in said outer position of said arms and inclined toward said axis in a direction away from said body in said inner position of said arms, means for elastically biasing said arms to said inner position, and a locking member located coaxially within said mandrel and defining a generally cylindrical surface whose axial extent is at least equal to said given axial extent of said impressions on said end parts, said method comprising:

placing said mandrel in said tube with said arms in said inner position;

axially shifting said locking member inwardly of said mandrel so as to shift said arms to said outer position and place said cylindrical surface in radial alignment with said impressions of said end parts and in engagement with said rectilinear surfaces on said end parts, and thereby locking said arms in said outer position;

actuating said hammers to cause them to travel alternately radially inwardly and strike said tube and radially outwardly as many times as necessary to form said corrugated shape, while causing a relative rotation of said hammers, said tube and said mandrel;

thereafter withdrawing said locking member relative to said mandrel to a position for allowing said arms to assume said inner positions under the action of said biasing means; and withdrawing said mandrel and said locking member from said tube.

* * * * *